US005855504A

United States Patent [19]

Hild et al.

[11] Patent Number: 5,855,504

[45] Date of Patent: Jan. 5, 1999

[54] HAND-OPERATED ORBITAL SANDER

[75] Inventors: Eugen Hild, Aichtal; Joao Bergner, Aidlingen, both of Germany

[73] Assignee: Robert Bosch GmbH, Stuttgart, Germany

[21] Appl. No.: 973,645

[22] PCT Filed: Feb. 28, 1997

[86] PCT No.: PCT/DE97/00145

§ 371 Date: Nov. 26, 1997

§ 102(e) Date: Nov. 26, 1997

[87] PCT Pub. No.: WO97/42001

PCT Pub. Date: Nov. 13, 1997

[30] Foreign Application Priority Data

May 2, 1996 [DE] Germany ..... 196 17 573.9

[51] Int. Cl.[6] ..... B24B 23/00

[52] U.S. Cl. ..... 451/357; 451/344; 451/342; 451/121; 451/163

[58] Field of Search ..... 451/357, 344, 451/163, 121, 342

[56] References Cited

U.S. PATENT DOCUMENTS 3,345,784 10/1967 Stelljes et al. ..... 451/357
4,729,194 3/1988 Maier et al. ..... 451/357
5,679,066 10/1997 Butz et al. ..... 451/357
5,709,595 1/1998 Bergner et al. ..... 451/357

FOREIGN PATENT DOCUMENTS 0 610 801 A1 8/1994 European Pat. Off. .

*Primary Examiner*—Robert A. Rose
*Assistant Examiner*—George Nguyen
*Attorney, Agent, or Firm*—Michael J. Striker

[57] ABSTRACT

In a hand-held orbital sander with a housing (12) and with a sanding tool (10) received in a tool holder (22), which is seated by means of a pivot bearing (21) on a rotating eccentric journal (20) protruding from the housing (12), an oscillating device (23), having an inner ring (26), an outer ring (27) and a formed part (28) made of elastic material connecting the two with each other is provided as a security against relative rotation, wherein the inner ring (26) is fastened on the tool holder (22) coaxially with the pivot bearing (21), and the outer ring (27) is maintained, fixed against relative totation, in the housing (12). The oscillating device (23) provides a symmetrical force distribution and makes it possible to set the torque of the tool holder (22) with the sanding tool (10) as needed in respect to the hardness or thickness of the elastic formed part (28) (FIG. 1).

8 Claims, 2 Drawing Sheets

HAND-OPERATED ORBITAL SANDER

PRIOR ART

The invention relates to a hand-held orbital sander of the species defined in the preamle of claim 1.

In a known orbital sander of this species, also known as electrical hand-held orbital sander (EP 0 610 801 A1), the flexible connection between the housing containing the electrical drive motor for the rotating eccentric journal and the tool holder with a sanding tool is embodied by means of oscillating elements with a T-profile, which are respectively mounted on the tool holder by means of their long, rod-shaped center brace, and extend away from it parallel with the pivot bearing axis, and are inserted form-fittingly by means of their shorter cross brace in the recesses formed in the housing.

ADVANTAGES OF THE INVENTION

In contrast therefor, the hand-held orbital sander in accordance with the invention with the characterizing features of claim 1 has the advantage, that by means of the oscillating device for the flexible connection of the tool holder to the housing embodied in accordance with the invention a symmetrical distribution of force takes place. The torque of the tool holder with the oscillating device can be adjusted as needed in accordance with grade and thickness of the elastic formed part. On the one hand, the oscillating device meets the requirements for the "hardest" possible torsion in an ideal way, which is advantageous for the removal action of sanding, and in another way a "soft" movement via the eccentric journal, which is advantageous for the stress on the pivot bearing.

The oscillating device in accordance with the invention allows a compact and flat structure of the orbital sander and in addition serves as a seal against sanding grit at the lower bearing of a main shaft driven by the electrical motor and holding the eccentric journal at its end.

Further advantageous developments and improvements of the hand-held orbital sander in accordance with claim 1 are possible by means of the steps recited in the additional claims.

DRAWINGS

The invention will be explained in more detail in the following description by means of an examplary embodiment shown in the drawings. Shown are in:

FIG. 1, a partial lateral view of a hand-held, electrical orbital sander, partially in section, FIG. 2, a top view of an oscillating device in the orbital sander in accordance with FIG. 1, FIG. 3, a lateral view of the oscillating device in accordance with FIG. 2 with a section along the line III—III in FIG. 2 on the right side of the drawings, FIG. 4, a view of the underside of an inner ring of the oscillating device in FIGS. 2 and 3.

DESCRIPTION OF THE EXEMPLARY EMBODIMENT

Figure 1:
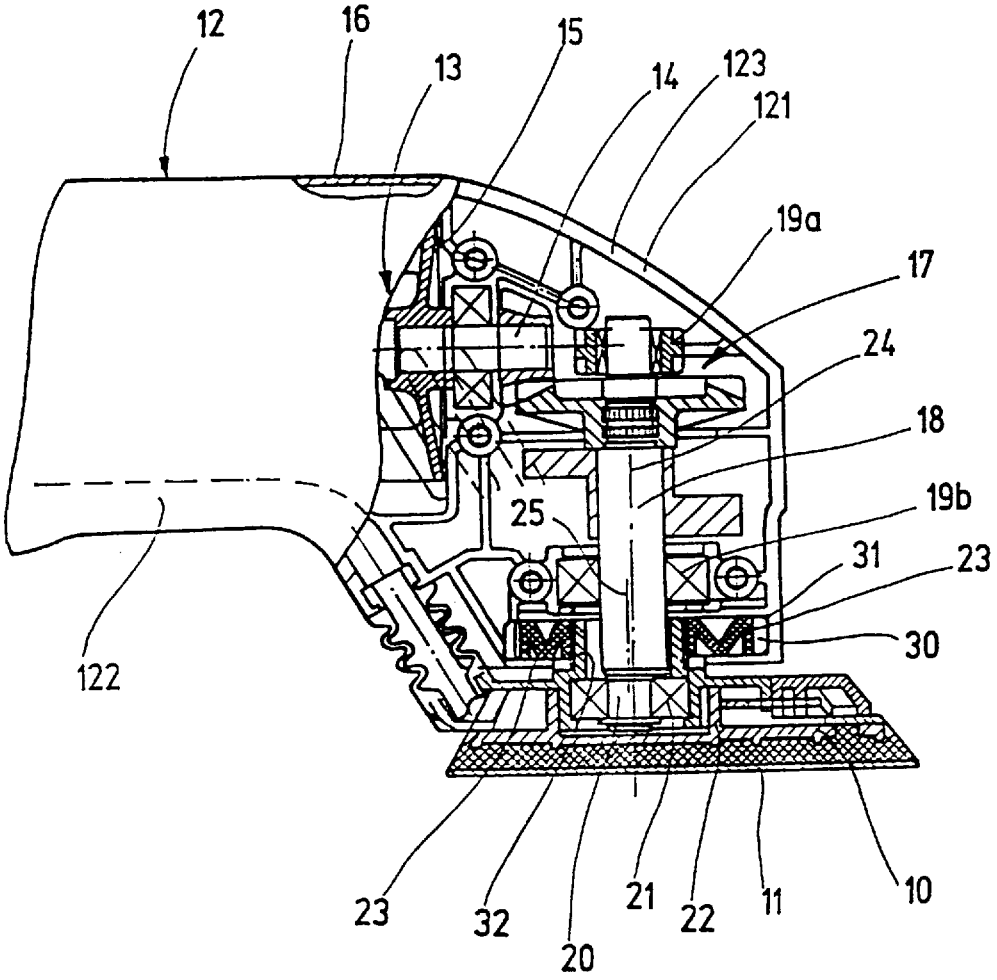

The hand-held, particularly electrical orbital sander shown partially in a lateral view and partially in section in FIG. 1 is embodied as a so-called Delta sander, which holds a triangular-shaped, symmetrical sanding wheel as sanding tool 10. The underside of the sanding wheel made of plastic is outfitted with a Velcro layer 11 for the acceptance of sanding wheels, not shown. The orbital sander can, however, also be equipped with a triangular-shaped sanding wheel or can be operated with other sanding tools, for example a multi-disc fixture or a sanding tongue or a sanding tube.

The orbital sander is comprised of a dual-shell housing 12, which is assembled by means of two housing shells 121, 122, which meet longitudinally at a joint 123 running parallel with the longitudinal axis of the housing. The housing 12 contains an electrical motor 13, of which merely the fan 15 seated on the power take-off shaft 14 can be seen in FIG. 1. A slidable switch 16 disposed on top of the housing 12 serves to switch the electrical motor 13 on and off. By means of a bevel gear 17, the power take-off shaft 14 drives a main shaft 18, which is rotatably seated in two ball bearings 19*a* and 19*b* firmly attached to the housing and with an eccentric journal 20 extends from the housing 12 at the lower end face of the housing 12. A tool holder 22 is seated on the eccentric journal 20 by means of a ball bearing 21 press-fitted into the tool holder 22, which receives on its underside the plate-shaped sanding tool 10 in a manner fixed against relative rotation and axially non-displaceable. The shape of the tool holder 22 and the sanding tool 10 are adapted to each other, so that the sanding tool 10 fits flat against the tool holder 22. The tool holder 22 made of plastic is firmly attached to the housing 12 via a flexible oscillating device 23 and in this way is secure against being rotatingly pulled along when the eccentric journal 20 is rotating. When the electrical motor 13 is switched on by means of the sliding switch 16, it drives the main shaft 18, which rotates around its axis 24, via the bevel gear 17. The eccentric journal 20, whose axis 25 is offset in respect to the axis 24 of the main shaft 18 by the eccentric measure, makes a circular movement, wherein the tool holder 22, which is prevented from being rotatingly pulled along by the flexible oscillating device 23, in placed into a circular orbital movement.

Figure 2:
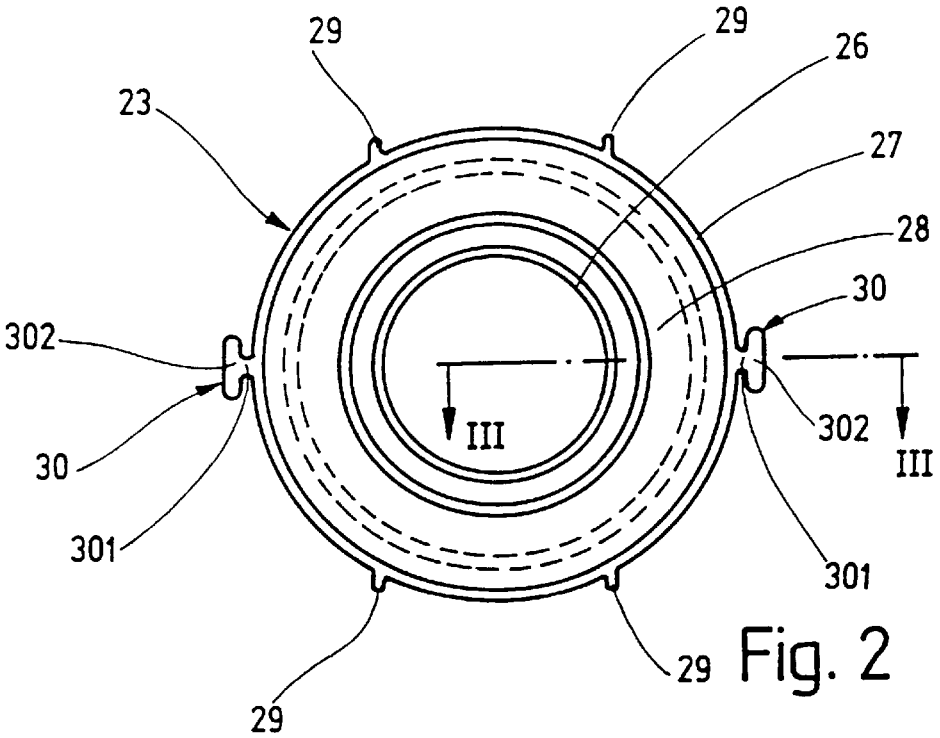
Figure 3:
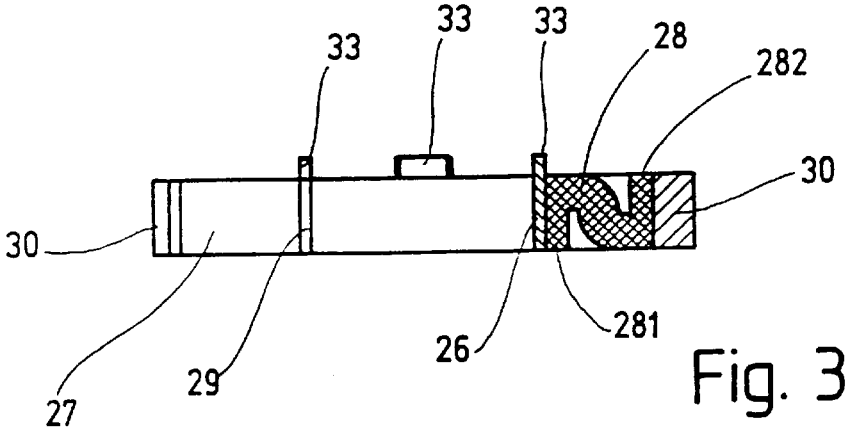
Figure 4:
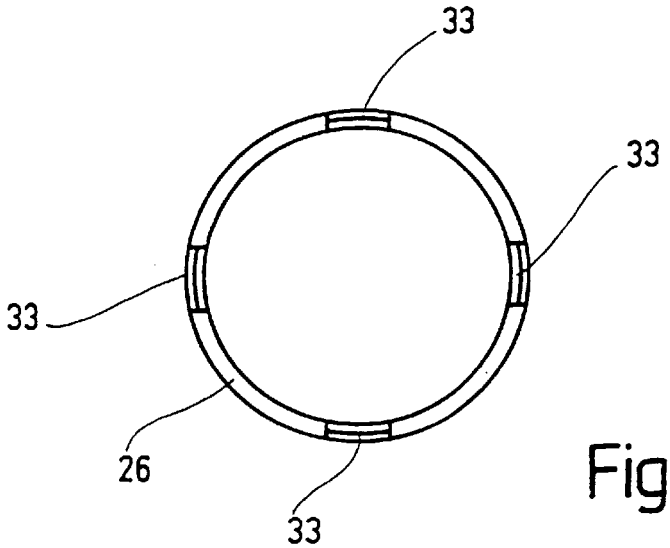

The oscillating device 23, shown in FIG. 2 and 3 in a top view and in a lateral view or respectively in cross section, is embodied as a ring, which is attachable with its radial inner area to the tool holder 22 and with its radial outer area to the housing 12. The oscillating device 23 particularly comprises an inner ring 26, an outer ring 27 disposed concentrically with it and a ring-shaped formed part 28 of an elastic material, which connects the inner and outer ring 26, 27 with each other. The inner ring 26 and outer ring 27 are made of plastic, and the formed part 28 is made of rubber or of an extrudable pliable plastic. As shown in FIG. 3, the ring-shaped formed part 28 has an N-shaped cross-section, wherein the two axially extending concentric, ring-shaped legs 281, 282 are respectively firmly connected with the inner ring 26 or respectively the outer ring 27. In a variation of the formed part 28 it can also have an M-shaped cross section, as shown in connection with the oscillating device 23 in FIG. 1. The inner ring 26 is attached to the tool holder 22 coaxially in respect to the bearing 21, and the outer ring 27 is held in the housing 12 fixed against relative rotation. For this purpose, the outer ring 27 has knobs 29, 30, formed in one piece with it on its outer side and distributed around its circumference, which are form-fittingly positioned in corresponding grooves inside the housing 12. Of the total of six knobs 29, 30 proposed here, the two knobs 30 facing each other diametrically are embodied to be T-shaped such, that their respective center brace 301 is radially extending away from the outer ring 27 and the cross brace 302 is received in a groove 31, each half of which is embodied in respectively one housing shell 121, 122 and extends to the joint 123. FIG. 1 shows only those groove halves of the two grooves 31, which are formed in the housing shell 121. The inner ring 26 is pushed onto a ring-shaped fitting 32 embodied coaxially with the axis 25 of the bearing 21 on top of the tool holder 22 and is fixedly connected with it, for example by means of soldering or bonding. For correct positioning of the ring device 23 during the push-on process onto the ring-shaped fitting 32, positioning cams 33 (FIGS. 3 and 4), formed on it in one piece and distributed on the lower front face of the inner ring 26 which, in the course of slipping the ring device 23 onto the ring-shaped fitting 32, form-fittingly enter into corresponding recesses in the ring-shaped fitting 32.

We claim:

1. A hand-held orbital sander with a housing (12) and with a sanding tool (10) received in a tool holder (22), which is seated by means of a pivot bearing (21) on a rotating eccentric journal (20) protruding from the housing (12) and which is flexibly connected to the housing (12), fixed against relative rotation, by means of at least one oscillating device (23), characterized in that the oscillating device (23) is embodied as a ring which can be attached with its radial inner area to the tool holder (22) and with its radial outer area to the housing (12).

2. The orbital sander in accordance to claim 1, characterized in that the oscillating device (23) is comprised of an inner ring (26), an outer ring (27) concentrically arranged in respect to it and a ring-shaped formed part (28) made of elastic material connecting an inner and outer ring (26,27) with each other, and in that the inner ring (26) can be fastened on the tool holder (22), essentially coaxially in respect to the pivot bearing (21), and the outer ring (27) can be maintained, fixed against relative rotation, in the housing (12).

3. The orbital sander in accordance with claim 2, characterized in that the outer ring (27) has knobs (29,30) spaced around its outer circumference and made of one piece with it, which form-fittingly engage corresponding grooves (31) embodied in the housing (12).

4. The orbital sander in accordance with claim 3, characterized in that the housing (12) is comprised of two housing shells (121, 122), assembled transversely along a joint (123) extending parallel with the longitudinal axis of the housing, and that of the knobs (30) formed on the outer ring (27) of the oscillating device (23), two diametrical knobs (30) are embodied in T-shape in such a way, that the respective center brace (301) of each knob (30) extends radially away from the outer ring (27) and the cross brace (302) of each knob (30) is received in a groove (31), with each half embodied in an respectively one housing shell (121, 122) and extends as far as the joint (123).

5. The orbital sander in accordance with claim 2, characterized in that a ring-shaped fitting (32) is formed on the tool holder (22), which is disposed coaxially to the pivot bearing axis (25) on top of the tool holder (22) facing away from the sanding tool (10) and in that the inner ring (26) of the oscillating device (23) is pushed onto the ring-shaped fitting (32) and is firmly connected with it, for example by means of soldering or bonding.

6. The orbital sander in accordance with claim 2, characterized in that on the front facing the tool holder (22), the inner ring (26) of the oscillating device (23) has positioning cams (33) made of one piece with it and distributed around its circumference for the correctly positioned seating of the inner ring (29) on the tool holder (22).

7. The orbital sander in accordance with claim 2, characterized in that the ring-shaped formed part (28) of the oscillating device (23) has an N- or M-shaped cross section, and in that the two axially extending concentric, ring-shaped legs (281, 282) are each fixedly connected with the inner or respectively outer ring (26, 27).

8. The orbital sander in accordance with claim 1, characterized in that the formed part (28) of the oscillating device (23) is made of rubber or an extrudable pliable plastic.

* * * * *